US006659869B1

(12) United States Patent
Akamatsu

(10) Patent No.: US 6,659,869 B1
(45) Date of Patent: Dec. 9, 2003

(54) CARD MANUFACTURING MACHINE, A CARD VENDING MACHINE, AND METHODS THEREFOR

(75) Inventor: Akihiro Akamatsu, Osaka (JP)

(73) Assignee: Make Software Co., Ltd., Osaka (JP)

( * ) Notice: Subject to any disclaimer, the term of this patent is extended or adjusted under 35 U.S.C. 154(b) by 0 days.

(21) Appl. No.: 09/936,760

(22) PCT Filed: Mar. 15, 2000

(86) PCT No.: PCT/JP00/01562

§ 371 (c)(1),
(2), (4) Date: Sep. 17, 2001

(87) PCT Pub. No.: WO00/54858

PCT Pub. Date: Sep. 21, 2000

(30) Foreign Application Priority Data

Mar. 17, 1999 (JP) ..... 11/072028

(51) Int. Cl.[7] ..... A63F 13/00

(52) U.S. Cl. ..... 463/31; 273/293; 273/296; 273/308; D21/378; D21/379; D21/384

(58) Field of Search ..... 273/293, 292, 273/296, 308; D21/378, 379, 383, 384; 463/31, 43

(56) References Cited

U.S. PATENT DOCUMENTS

| | | | | |
|---|---|---|---|---|
| 5,513,117 A | | 4/1996 | Small | |
| 5,687,306 A | * | 11/1997 | Blank | 395/135 |
| 5,873,605 A | | 2/1999 | Kaplan | |
| 5,887,873 A | * | 3/1999 | Freeman | 273/303 |

FOREIGN PATENT DOCUMENTS

| | | |
|---|---|---|
| JP | 55-154063 | 11/1980 |
| JP | U5748977 | 3/1982 |
| JP | 3-98892 | 10/1991 |
| JP | 7-56056 | 12/1995 |
| JP | 10-229535 | 8/1998 |
| JP | B13038332 | 2/2000 |
| WO | A19836565 | 8/1998 |

* cited by examiner

*Primary Examiner*—Benjamin H. Layno
(74) *Attorney, Agent, or Firm*—Birch, Stewart, Kolasch & Birch, LLP

(57) ABSTRACT

A card vending machine for vending a card, responsive to the taste of a user, such as a playing card, a karuta or a tarot card employed for a game synthesizes an image (300) obtained by photographing an object (particularly the user) and an image (100*a* to 100*d*) such as a mark of a playing card or a numeral and vends the same as a card.

8 Claims, 10 Drawing Sheets

CARD MANUFACTURING MACHINE, A CARD VENDING MACHINE, AND METHODS THEREFOR

This application is the national phase under 35 U.S.C. §371 of PCT International Application No. PCT/JP00/01562 which has an International filing date of Mar. 15, 2000, which designated the United States of America.

TECHNICAL FIELD

The present invention relates to a card manufacturing machine, a card vending machine, a card and a card-type plaything, and more particularly, it relates to a card manufacturing machine capable of manufacturing a card desired by a user and a card vending machine as well as a card and a card-type plaything having a wide variety of games.

1. Background Art

In general, a card-type plaything such as a pack of playing cards, karuta or tarot cards is formed by a number of cards of the same size, and game images of a made numerals, characters, a picture etc. necessary for a game and decorative images such as colors and patterns not directly related to the game and printed on each card. In order to provide such a card-type plaything to consumers at a low price, the manufacturer must mass-produce card-type playthings consisting of cards on which the same decorative images are printed.

The present invention aims at providing a card manufacturing machine capable of manufacturing a card responsive to the taste of a user, a card vending machine and a method, as well as a card and a card-type plaything having a wide variety of games.

2. Disclosure of the Invention

In order to solve the aforementioned problem, a card manufacturing machine for manufacturing a card such as a playing card, a karuta or a tarot card employed for a game is provided which comprises a photographing part for photographing an object, a print part for printing an image obtained by the photographing and a game image necessary for a game selected by a user on the card according to one aspect of the present invention.

Preferably, the card manufacturing machine further comprises a selection part for making the user select a desired image from a plurality of images, and a print part for printing the image obtained by the photographing and the selected image on the card.

Preferably, the print part prints the image obtained by the photographing on one surface of the card and prints the selected image on another surface of the card.

Preferably, the card includes a storage part for rewritably storing information, and the card manufacturing machine comprises a write part for writing information in the storage part.

According to another aspect of the present invention, a card vending machine comprises the card manufacturing machine described in any of the above which vends a card manufactured in the card manufacturing machine upon payment of the price.

According to still another aspect of the present invention, a card is manufactured by the card manufacturing machine described in any of the above.

According to a further aspect of the present invention, a card vending machine, which is a card vending machine vending a card such as a playing card, a karuta or a tarot card employed for a game, comprises a print part printing an image responsive to the taste of a user and a game image necessary for a game selected by the user on the card.

According to a further aspect of the present invention, a card is printed by the aforementioned card vending machine.

According to a further aspect of the present invention, a card such as a playing card, a karuta or a tarot card employed for a game is characterized in that a labyrinthine image is printed on its back.

According to a further aspect of the present invention, a card-type plaything consisting of a plurality of cards such as playing cards, karuta or tarot cards employed for a game includes a first card having a first labyrinthine image printed on its back and a second card having a second labyrinthine image different from the first labyrinthine image printed on its back.

According to a further aspect of the present invention, a card manufacturing method with a card manufacturing machine for manufacturing a card such as a playing card, a karuta or a tarot card employed for a game comprises a photographing step of photographing an object and a printing step of printing an image obtained by the photographing and a game image selected by a user on the card.

Preferably, the card manufacturing method further comprises a selection step of making the user select a desired image from a plurality of images, for printing the image obtained by the photographing and the selected image on the card in the printing step.

Preferably, the printing step prints the image obtained by photographing on one surface of the card.

Preferably, the card includes a storage part rewritably storing information, and the card manufacturing method comprises a writing step of writing information in the storage part.

According to a further aspect of the present invention, a card vending method includes the card manufacturing method described in any of the above which vends a card manufactured by the card manufacturing method upon payment of the price.

According to a further aspect of the present invention, a card is manufactured by the card manufacturing method described in any of the above.

According to a further aspect of the present invention, a card vending method, which is a card vending method of vending a card such as a playing card, a karuta or a tarot card employed for a game, comprises a printing step for printing an image responsive to the taste of a user and a game image selected by the user on the card.

According to a further aspect of the present invention, a card is vended by the aforementioned card vending method.

BEST MODES FOR CARRYING OUT THE INVENTION

Figure 1:
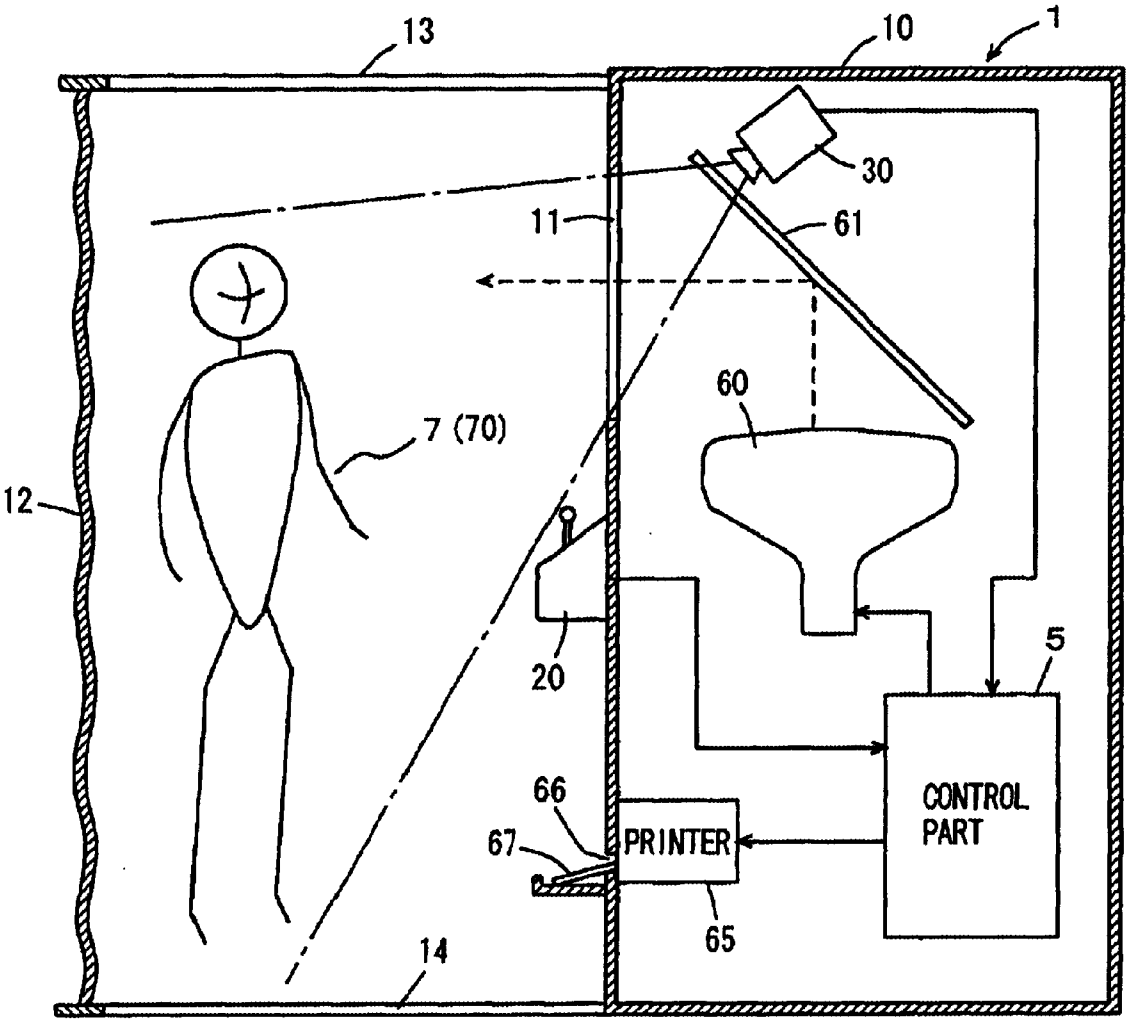
FIG. 1 is a typical diagram showing the structure of a card vending machine in one of embodiments of the present invention.

In order to describe the present invention in more detail, reference is made to the accompanying drawings, wherein FIG. 1 shows a card vending machine 1 for playing cards, in one of the embodiments of the present invention.

While this embodiment synthesizes an image obtained by photographing an object on a game image necessary for a game and uses the same, the present invention is not restricted to this embodiment.

In the card vending machine 1, various types of devices are arranged in or on the surface of a box 10. It is assumed for convenience of illustration that the side of the box 10 facing a user (user) 7 is the front side. In other words, it is assumed that the left side of the plane is the front side of the box 10 and the right side is the back side of the box 10 in relation to the box 10 of FIG. 1. While an arbitrary body can be selected as an object 70, it is assumed that the whole body of the user 7 is the object 70 in this embodiment.

A curtain 12 intercepting external light is arranged at the back of the object 70. The curtain 12 is supported by front projecting support frames 13 from an upper portion and a lower portion of the front surface of the box 10. The inner surface of the curtain 12 is provided with a color responsive to a method of synthesizing images. If, for example, chroma key synthesis is used, the overall inner surface of the curtain 12 is painted blue.

A video camera (or a digital camera) 30 (hereinafter referred to as a camera 30) for photographing the object 70, a control part 5 for receiving an image signal from the camera 30 and synthesizing the images, a display 60 for receiving an image signal from the control part 5 and displaying an image and a printer 65 for receiving a signal of a synthetic image from the control part 5 and printing the synthetic image, are all arranged in the box 10 of the card vending machine 1.

In this embodiment, a synthetic image which the user 7 observes from the display 60 and the synthetic image printed from the printer 65 are obtained by synthesizing the image of the user 70 and the stored image previously stored in the control part 5.

An upper portion of the front surface of the box 10 opens and a transparent plate 11 of glass or plastic is arranged in this opening so that the camera 30 can photograph the object 70 and the user 7 can observe the image displayed on the display 60. A half mirror 61 is arranged at the back of the transparent plate 11, and the display 60 is arranged under the half mirror 61.

The display 60 and the half mirror 61 are so arranged that light emitted from the display 60 is reflected by the half mirror 61 and reaches the user 7.

Therefore, it follows that the user 7 observes the image displayed on the display 60. Therefore, a prescribed image must be displayed on the display 60. For this, the control part 5 may transmit a prescribed image signal to the display 60.

The camera 30 is arranged at the back of the half mirror 61. The camera 30 is arranged to be capable of photographing the whole body of the object 70, i.e., the user 7. The distance between the camera 30 and the object 70 is preferably short in view of a space for arranging the vending machine. In order to photograph the whole body of the user 7 under this condition, a wide angle lens is preferably arranged on the camera 30. The camera 30 is connected to the control part 5 and transmits a photograph signal of the object 70 to the control part 5.

The printer 65 receiving the image signal from the control part 5 and printing the image on a card base 67 is arranged in proximity to the front surface in the box 10, and a pickup part 66 delivering the printed card base 67 from the printer 65 outward from the box 10 is formed on a position of the front surface of the box 10 adjacent to the printer 65. Paper, plastic or the like is used as the material for the card base 67.

An operating part 20 is arranged on the front surface of the box 10 at a position easy to operate for the user 7. The operating part 20 has buttons, levers or the like with which the user 7 performs various operations, forms an operation signal on the basis of the operations of the user 7 and transmits the same to the control part 5.

A slot (not shown) is provided on the front surface of the box 10 at a position convenient to the user 7 for inserting a coin (a kind of price), and a coin detection part 25 (see FIG. 2) detecting the inserted coin is arranged on a position in the box 10 adjacent to the slot. The coin detection part 25 transmits a detection signal to the control part 5.

A speaker 63 (see FIG. 2) receiving a sound signal from the control part 5 and outputting a sound is arranged on a proper position of the front surface of the box 10.

Figure 2:
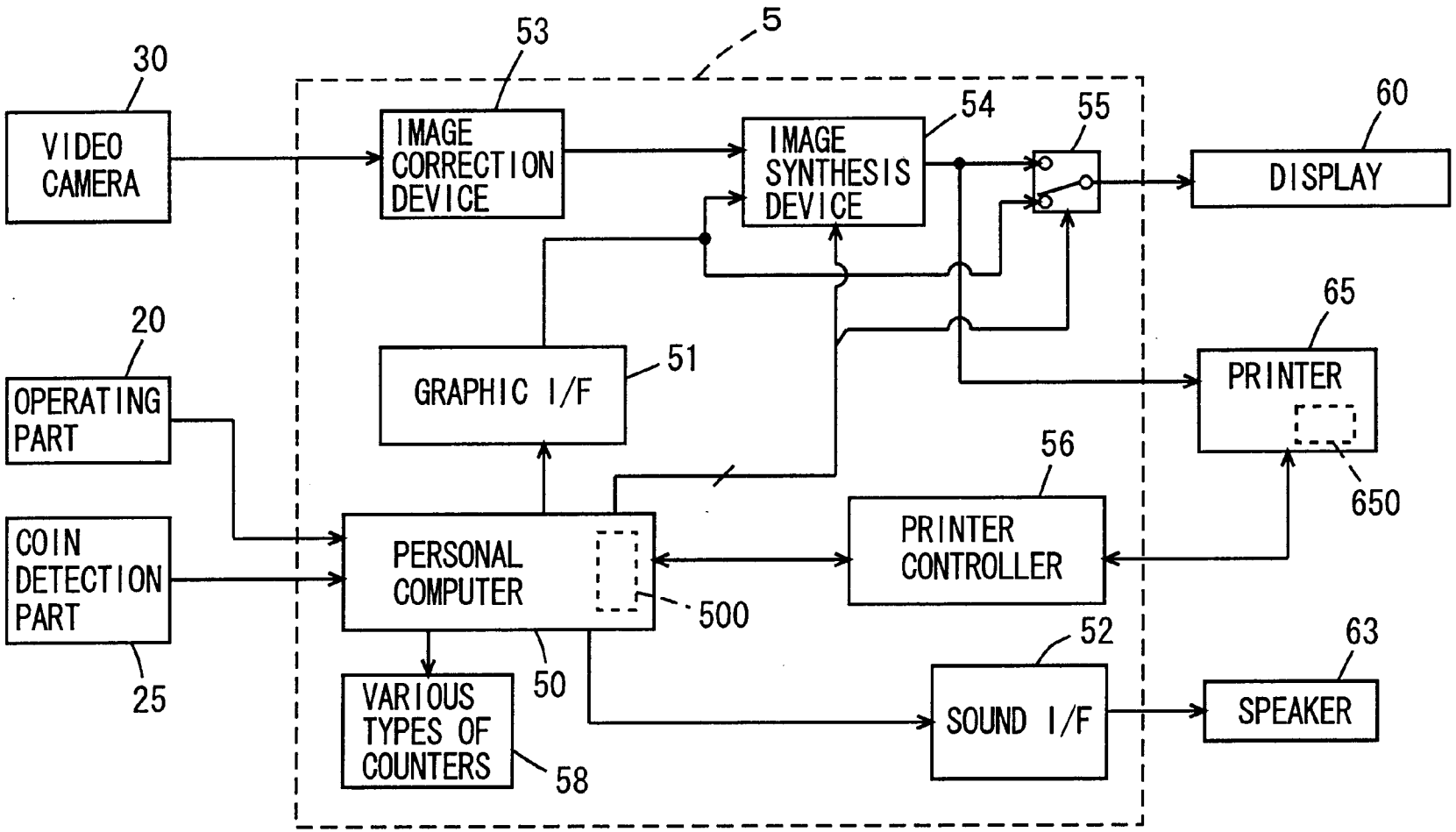
FIG. 2 is a block diagram showing the structure of a control part 5 of FIG. 1.

FIG. 2 is a block diagram showing the principal structure of the control part 5.

The control part 5 includes a personal computer 50 (hereinafter referred to as "PC 50") executing various types of control. The PC 50 receives the operation signal from the operating part 20, and receives the detection signal from the coin detection part 25. The PC 50 includes a memory 500 storing a plurality of image data and sound data. The PC 50 reads specified image data from the memory 50 and transfers the same to a graphic I/F (interface) circuit 51, while reading specified sound data from the memory 500 and transferring the same to a sound I/F circuit 52.

The graphic I/F circuit 51 converts the storage image data received from the PC 50 to a prescribed storage image signal and transmits the same to an image synthesis device 54 and a display selection circuit 55. The sound data which the sound I/F circuit 52 receives from the PC 50 is converted to a prescribed sound signal and transmitted to the speaker 63, whereby the sound is output from the speaker 63.

In the case of this embodiment, a demonstration image (hereinafter referred to as "demo image"), a plurality of back images previously printed or to be printed on the back of the card base 67, a plurality of decorative images to be printed on the surface of the card base 67 and a plurality of index images to be printed on the surface of the card base 67 are included in images stored in the memory 500 as the image data. The index images, showing marks of the types (club, diamond, heart or spade) to which playing cards belong and ranks (ace, 2 to 10, jack, queen or king) of the playing cards or a joker, are generally printed on the upper left and the lower right of the surfaces of the playing cards.

The image signal of the object 70 from the camera 30 is received by an image correction device 53, and the image correction device 53 corrects the image of the object 70. This is because, when the camera 30 and the object 70 are in the arrangement shown in FIG. 1, the image of the object 70 photographed by the camera 30 has a trapezoidally distorted shape with a large head portion and small leg portions. The image signal of the object 70 corrected by the image correction device 53 is transmitted to the image synthesis device 54.

The image synthesis device 54 receives the image signal of the object 70 as a first image signal, receives the image signal of the storage image from the graphic I/F circuit 51 as a second image signal, and synthesizes the first image and the second image. A method of synthesizing the images is described in Japanese Utility Model Registration No. 3043855, Japanese Utility Model Registration No. 3051776 or the like in detail, and hence detailed description thereof is omitted here. The image synthesis device 54 has a plurality of synthesis methods, and it is preferable to select a single synthesis method by an instruction from the PC 50. The synthesized image signal is transmitted to the display selection circuit 55 and the printer 65.

The display selection circuit 55 receives the synthetic image signal from the image synthesis device 54 and the storage image signal from the graphic I/F circuit 51, selects either image signal on the basis of a control signal from the PC 50 and transmits the same to the display 60. The display 60 receives the image signal from the display selection circuit 55 and displays the image.

The control part 5 includes a printer controller 56 controlling the printer 65 on the basis of a control signal from the PC 50. The printer 65 receives the synthetic image signal from the image synthesis device 54, stores the data of the synthetic image in a memory 650 built in the printer 65, forms a print image on the basis of the synthetic image data and prints the print image on the card base 67 of a prescribed size under control by the printer controller 56.

Data is directly transferred from the PC 50 to the printer 65 so that printing on the back of the card is performed. The data is present in the memory 500.

The control part 5 includes various types of counters 58 counting/displaying the number of inserted coins and the like.

Operations of the card vending machine 1 having the aforementioned structure are now described.

Until the user 7 inserts a coin, the display selection circuit 55 selects the graphic I/F circuit 51 side by an instruction from the PC 50. The PC 50 reads the data of the demo image previously stored in the memory 500 and transfers the same to the graphic I/F circuit 51, whereby a demo screen is displayed on the display 60. The PC 50 reads BGM (background music) data previously stored in the memory 500 and transfers the same to the sound I/F circuit 52, whereby background music is played through the speaker 63.

Figure 3:
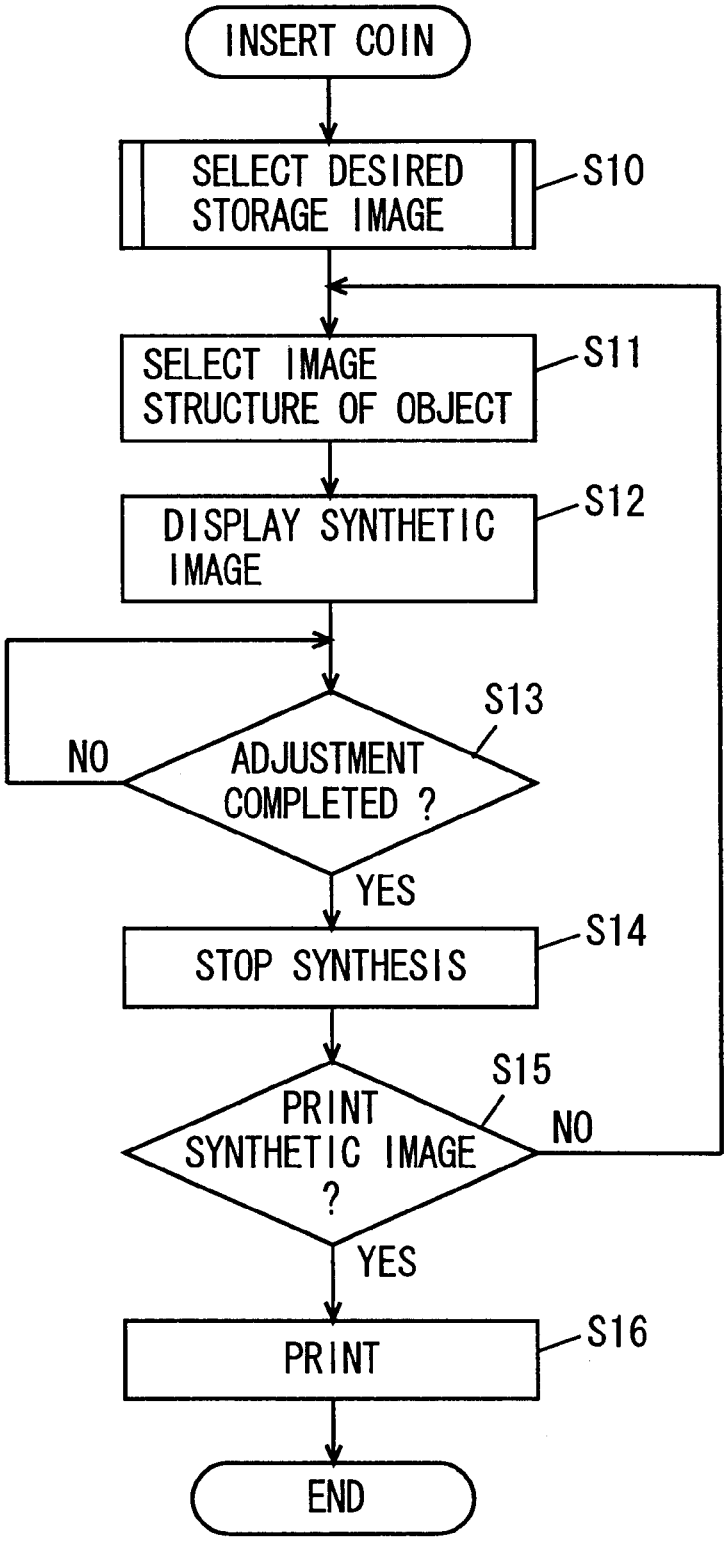
FIG. 3 is a flow chart showing operations at the time when a user inserts a coin in the card vending machine.

When the user 7 inserts a coin and the PC 50 receives the detection signal from the coin detection part 25, the PC 50 reads the image data and the sound data previously stored in the memory 500 at proper timing and transmits the read image data to the display 60 through the graphic I/F circuit 51 and the display selection circuit 55 while transmitting the read sound data to the speaker 63 through the sound I/F circuit 52 for properly supplying an instruction to the user 7 with the image on the display 60 and the sound from the speaker 63 and performing operations shown in FIG. 3.

Figure 4:
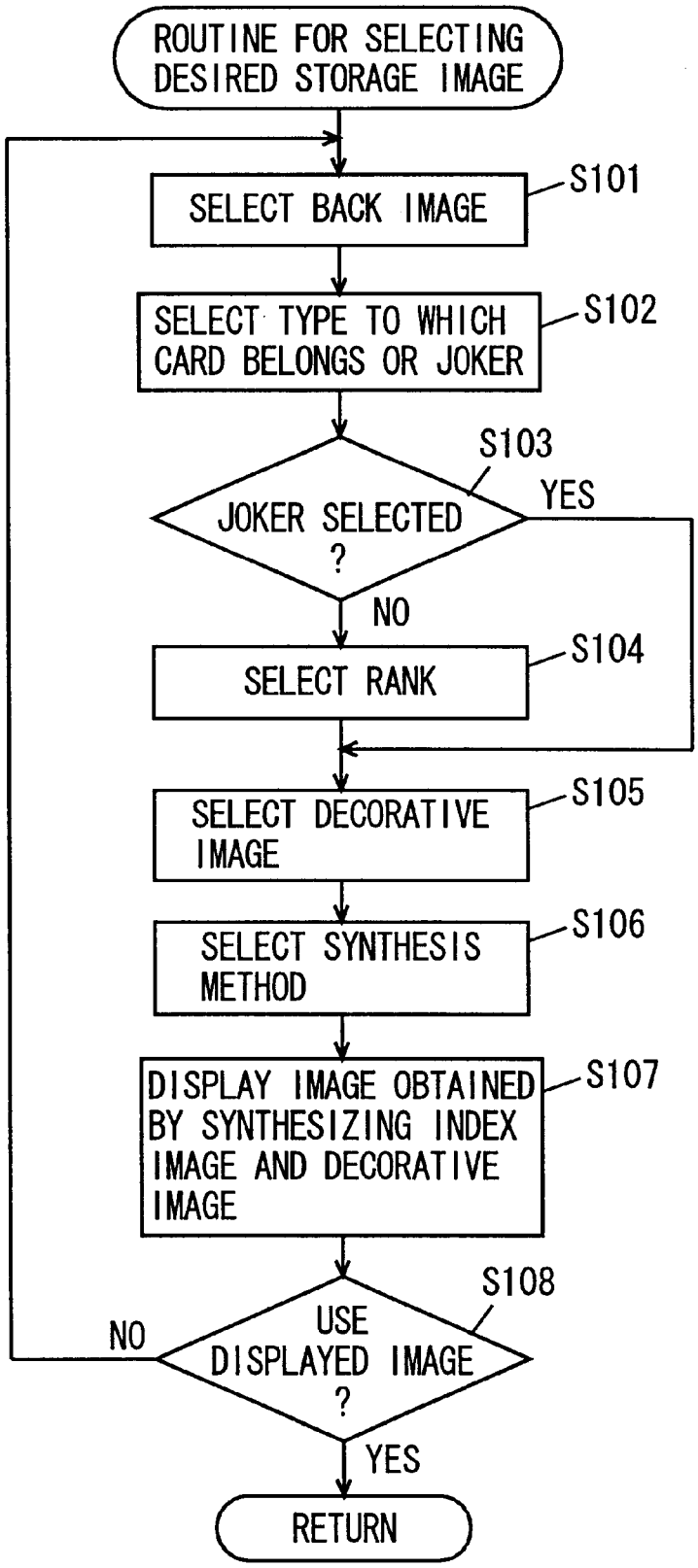
FIG. 4 is a flow chart showing the contents of processing (S10) for selecting a desired storage image in FIG. 3.

Referring to FIG. 3, it first successively reads a plurality of storage image data stored in the memory 500 and makes the display 60 display the same through the graphic I/F circuit 51 and the display selection circuit 55, and makes the user 7 operate the operating part 20 and select a desired storage image (S10). FIG. 4 shows a flow chart illustrating this routine in detail.

Referring to FIG. 4, it first makes the display 60 display a plurality of back images and makes the user 7 select a desired back image (S101).

Then, it makes the user 7 select an index image. More specifically, it makes the display 60 display the marks of the types to which the cards belong and the mark of the joker, and makes the user 7 select a desired mark (S102).

Then, it determines whether or not the user selects the mark of the joker (S103), for making the display 60 display images indicating the ranks of the cards and making the user 7 select a desired image (S104) when not selecting the joker, while advancing to a next step when selecting the joker.

Thus, the type and the rank of the card the user 7 desires or a supply joker is selected.

Then, it makes the display 60 display the plurality of decorative images and makes the user 7 select a desired decorative image (S105). At this time, the PC 50 may select a decorative image at random in place of the user 7 selecting the decorative image.

Then, it makes the user 7 select a method of synthesizing the images S106). Then, the PC 50 synthesizes the selected index image and decorative image by the selected synthesis method, and makes the display 60 display the synthesized storage image (S107).

Then, it makes the user 7 determine whether or not to utilize the synthetic storage image displayed on the display 60 (S108), for returning to the step S101 when making selection again without utilizing it while returning to the original routine and continuously transferring the data of the synthetic storage image to the graphic I/F circuit 51 when utilizing it.

As the structure of the object image synthesized into the synthetic storage image, an image of the whole body or an image of the upper half of the body, a single image or a plurality of images, a one-shot image or plural-shot images can be exemplified. After selecting the desired storage image (S10), therefore, the user selects one from the aforementioned image structures of the object 70 (S11).

Then, the PC 50 instructs the image synthesis device 54 to convert the image of the object 70 to the selected image structure and thereafter synthesize the converted image of the object 70 and the synthesized storage image in real time while switching the display selection circuit 55 to the image synthesis device 54 side and making the display 60 display the synthetic image from the image synthesis device 54 in real time (S12).

Then, when the user 7 presses an adjustment end button of the operating part 20 after completing position adjustment of the object 70 while observing the display image on the display 60 (S13), the PC 509 instructs the user 7 to pose and then instructs the image synthesis device 54 to stop image synthesis (S14). At this time, the synthetic image immediately before stoppage is displayed on the display 60 as a static image.

Then, the user 7 determines whether or not to print the said still image (S15) for pressing a retake button of the operating part 20 when making a retake without printing while pressing a print button of the operating part 20 when performing printing. When the retake button is pressed, the PC 50 returns to the step S81 and repeats the aforementioned operations.

When the print button is pressed, the PC 50 transmits an instruction signal to the printer controller 56 to make the printer 65 print the said still image on the surface of the card base 67 and print the selected back image on the back, and provides the printed card base 67 to the user 7 (S16).

Until another coin is inserted, it plays background music and displays the demo image similarly to the aforementioned case before coin insertion.

When this embodiment is structured and operates as described above, the memory 500 in the PC 50 stores the game image and the decorative image as digital data and hence it is easy to synthesize the game image and the decorative image. The synthesized image is immediately printed in the printer 65, and hence a card provided with various colors or patterns can be produced at a low cost and in a short time by selection of the user 7.

Further, the card vending machine 1 according to this embodiment synthesizes the image of the object 70 photographed with the camera 30 on the image obtained by synthesizing the game image and the decorative image in the PC 50 with the image synthesis device 54 and prints the same with the printer 65, and hence it follows that the degree of freedom of images selectable by the user 7 widens.

Specific examples of the actually printed card are now described.

Figure 5:
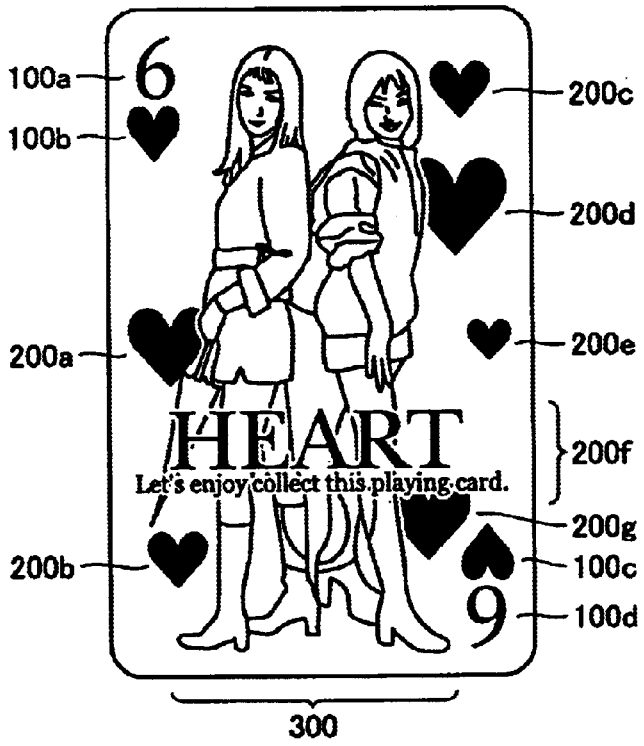
FIG. 5 is a diagram showing a first specific example of the surface of a printed card.

FIG. 5 is a diagram showing a first specific example of the surface of the printed card.

Referring to the figure, game images 100*a* to 100*d* necessary for a game, decorative images 200*a* to 200*g* not directly related to the game and object images (personal images here) 300 are synthesized on the card.

Images of the whole bodies of persons are printed as the object images here.

Figure 6:
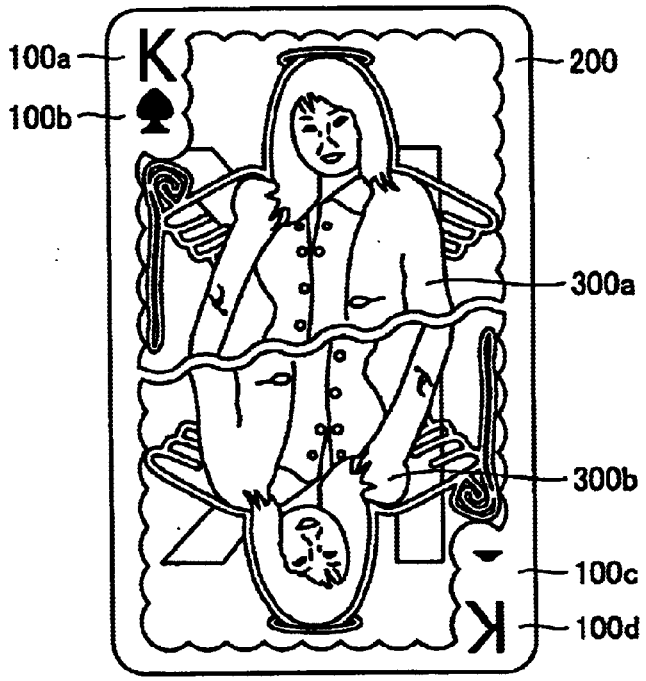
FIG. 6 is a diagram showing a second specific example of the surface of the printed card.

FIG. 6 is a diagram showing a second specific example of the surface of the printed card.

Referring to the figure, game images 100*a* to 100*d* necessary for a game, a decorative image 200 not directly related to the game and object images 300*a* and 300*b* are synthesized on the card.

Images of the upper half of the body of the same person are printed to be vertically symmetrical as the object images here.

Figure 7:
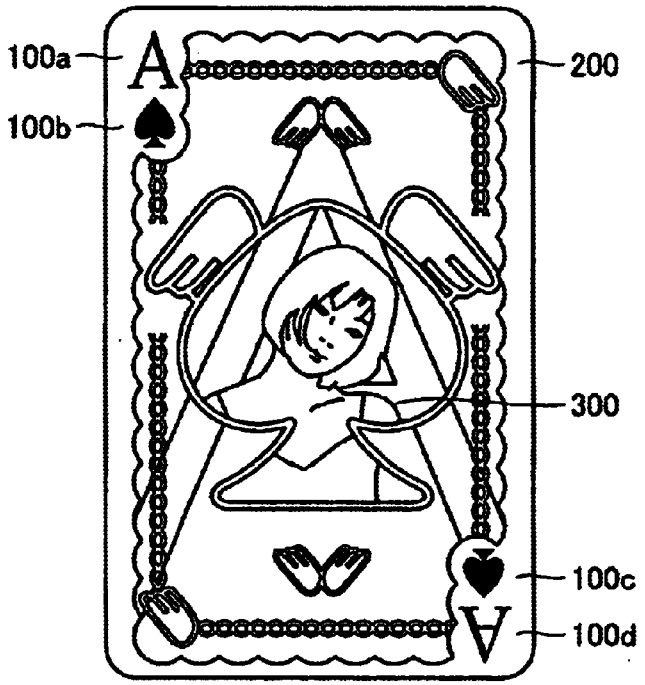
FIG. 7 is a diagram showing a third specific example of the surface of the printed card.

FIG. 7 is a diagram showing a third specific example of the surface of the printed card.

Referring to the figure, game images 100*a* to 100*d* necessary for a game, a decorative image 200 not directly related to the game and an object image 300 are synthesized on the card.

The facial part of a person is printed as the object image here.

Figure 8:
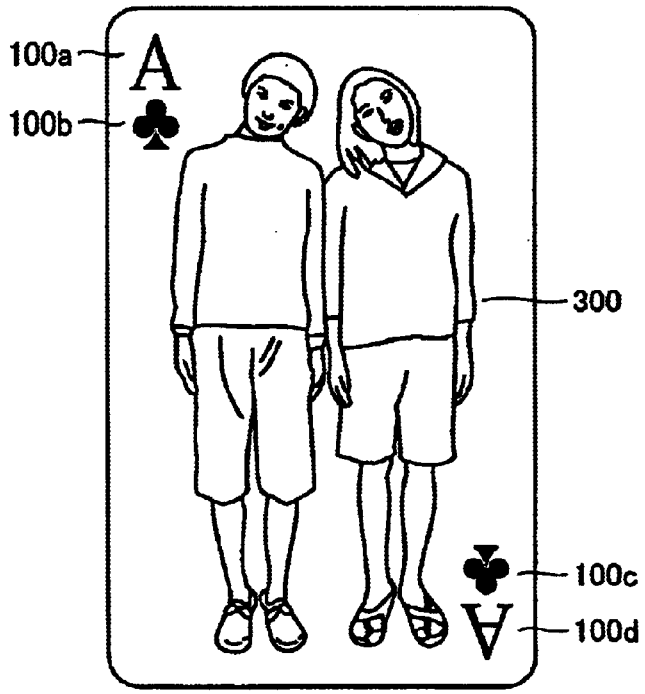
FIG. 8 is a diagram showing a fourth specific example of the surface of the printed card.

FIG. 8 is a diagram showing a fourth specific example of the surface of the printed card.

Referring to the figure, game images 100*a* to 100*d* necessary for a game and object images 300 are synthesized on the card.

The user can purchase the cards shown in FIG. 5 to FIG. 8 by self selection.

Figure 9:
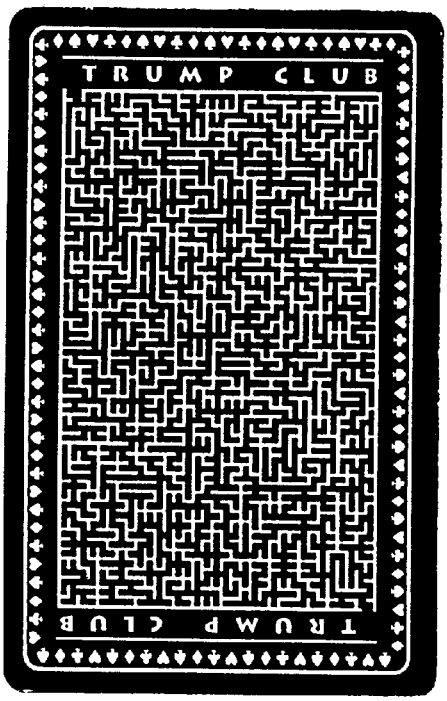
FIG. 9 is a diagram showing a first specific example of a back image of a card.
Figure 10:
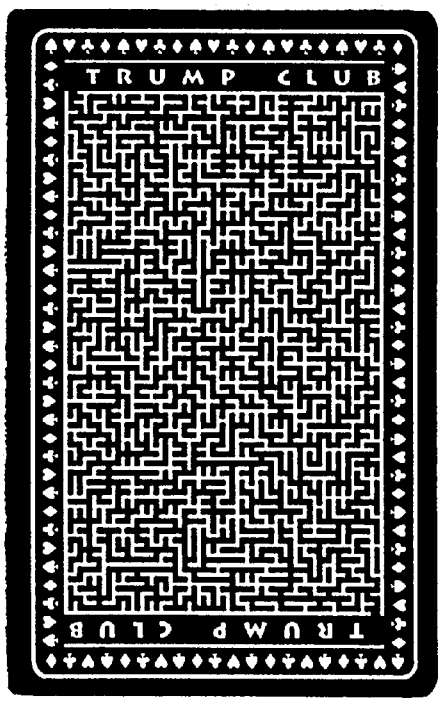
FIG. 10 is a diagram showing a second specific example of the back image of the card.

FIG. 9 and FIG. 10 are diagrams showing specific examples of the back image of the card.

Referring to the figures, images of labyrinths are included in the back images to appear to be patterns to the human eyes at a glance. While FIG. 9 and FIG. 10 are labyrinthine images different from each other, the same appear to be the same patterns to the human eyes at a glance.

When printing an image of a labyrinth on the back of the card in this manner, variations of the game with the card widen. Also when printing different labyrinthine images on the respective ones of cards included in a pack of cards, they give the impression as if they are the same patterns to the human eyes at a glance, and hence they do not hinder the essential game object of the playing cards.

While the printer 65 of this embodiment prints the images on both surfaces of the card base, a plurality of card bases 67 on which back images are previously printed may be prepared for selecting a card base 67 on which a back image selected by the user 7 is printed from the card bases 67 and printing a still image on the surface of the selected card base 67.

While this embodiment vends a single card used for a card-type plaything, it is also possible to vend cards (if playing cards, 54 cards including two jokers) of a number necessary for playing a game.

Further, a magnetic recording part capable of rewriting information may be previously arranged on the card base 67 and a function of a magnetic writer writing information in the magnetic recording part may be added to the printer 65 printing the image.

Another storage part such as an IC can be arranged on the card base in place of a magnetic body. In this case, it follows that a function of writing information in the storage part is added to the printer 65. In addition, a write part writing information in the storage part 65' can be arranged on the card vending machine 1 independently of the printer 65.

When thus providing a storage part on the card, writing a message, a date, a cipher and the like in the storage part, reading the written contents with another device (or the card vending machine performing writing) and making display (or printing), it is possible to increase the number of variations of the game with the card.

While this embodiment synthesizes and prints the image of the object 70 photographed with the camera 30, the effect of the present invention can be attained also when synthesizing and printing the game image and the decorative image selected by the user 7 without synthesizing the object image. In this case, the camera 30, the image correction device 53 and the image synthesis device 54 are unnecessary.

Further, Japanese playing cards, cards of the Hundred Poems by One Hundred Poets and other cards for games may be vended as cards.

While the above embodiment has been described with reference to a card vending machine, the present invention is also applicable to a card manufacturing machine simply manufacturing cards with no payment of the price.

Further, the present invention is applicable also to a device printing an image (image responsive to the taste of the user) that the user obtains by selection, entry, drawing or photographing on a card.

Figure 11:
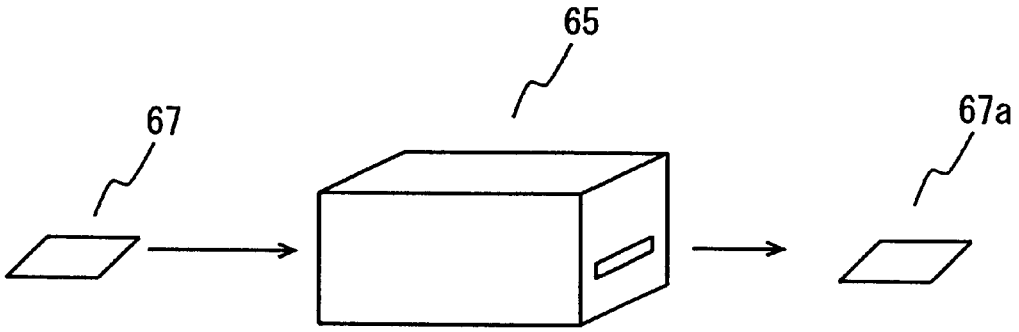
FIG. 11 is a diagram showing a specific example of a printer 65.
Figure 12:
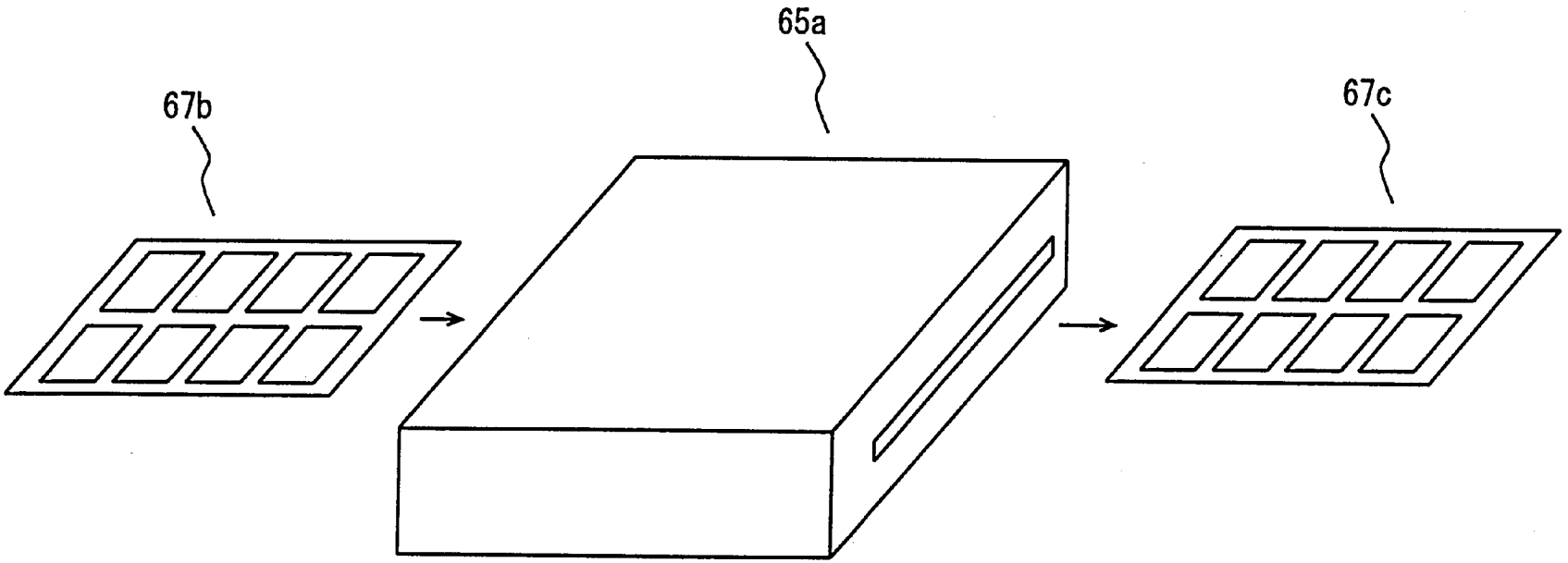
FIG. 12 is a diagram showing a second specific example of the printer.

The printer 65 may perform printing on the card base 67 for obtaining a single card 67*a* as shown in FIG. 11, or a printer 65*a* performing printing on a card base 67*b* including a plurality of cards shown in FIG. 12 may be employed as the printer.

In other words, the user can purchase eight cards at once in the example of FIG. 12. Different images may be printed on the respective ones of the eight cards, or eight identical cards may be printed. Further, the number of the cards is not restricted to eight.

Figure 13:
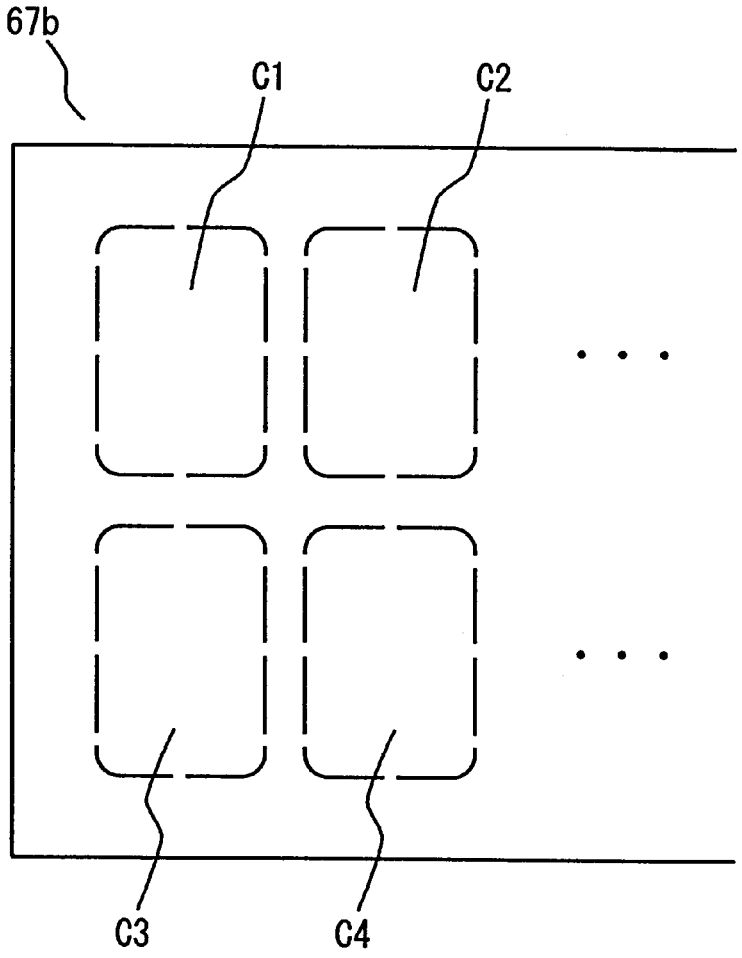
FIG. 13 is a plan view of a card base 67*b* of FIG. 12.

FIG. 13 is a plan view of the card base 67*b* of FIG. 12. Referring to the figure, the card base 67*b* is made of plastic or paper, and the user can cut off cards C1 to C4 along dotted lines.

Figure 14:
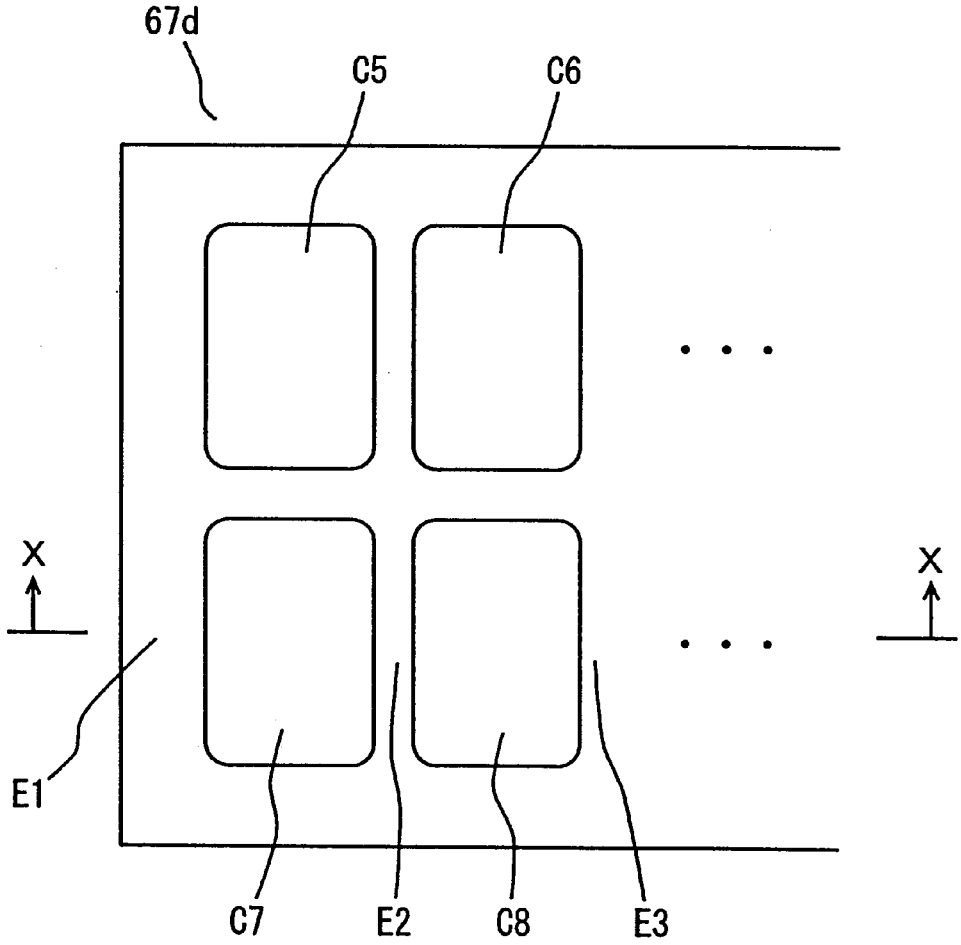
FIG. 14 is a diagram showing a modification of the card base of FIG. 13.
Figure 15:
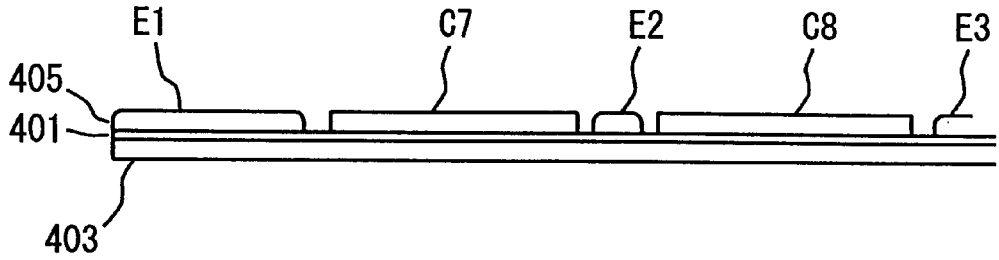
FIG. 15 is an X—X sectional view of FIG. 14.

A card base 67*d* of FIG. 14 and FIG. 15 may be employed in place of the card base 67*b* of FIG. 13.

FIG. 14 is a plan view of the card base 67*d*, and FIG. 15 is a sectional view along the line X—X in FIG. 14. The card base is formed by a mount 403, an adhesive surface (paste surface) 401 adhering to the mount and a card surface 405 made of plastic or paper. The card surface is so notched that the card surface 405 is divided into edge parts E1 to E3 and cards C5 to C8.

The user can obtain the separated cards C5 to C8 by peeling the cards C5 to C8 from the mount 403. At this time, it is effective to make paste of the paste surface 401 not adhere to the card.

The edge parts E1 to E3 may not be provided on the card base.

The embodiment disclosed this time is to be considered as illustrative in all points and not restrictive. The scope of the present invention is shown not by the above description but by the scope of claim for patent, and it is intended that all modifications within the meaning and the range equivalent to the scope of claim for patent are included.

Industrial Applicability

According to the present invention, as hereinabove described, it is possible to provide a card-type plaything responsive to the taste of the user, and hence the present invention can be advantageously applied to a card-type plaything manufacturing device or the like.

What is claimed is:

1. A card manufacturing machine for manufacturing a card such as a playing card, a karuta or a tarot card employed for a game, comprising:

a photographing part for photographing an object;

a print part for printing an image obtained by said photographing; and a game image necessary for a game selected by a user on said card, wherein said card includes;

a storage part for rewritably storing information, and said card manufacturing machine comprises a writing part for writing information in said storage part.

2. The card manufacturing machine according to claim 1, further comprising a selection part for making the user select a desired image from a plurality of images, wherein said print part prints the image obtained by said photographing and said selected image on said card.

3. The card manufacturing machine according to claim 2, wherein said print part prints the image obtained by said photographing on one surface of said card and prints said selected image on another surface of said card.

4. A card vending machine comprising the card manufacturing machine according to claim 1, wherein the card manufactured in said card manufacturing machine is vended upon payment of a price.

5. A card vending machine for vending a card such as a playing card, a karuta or a tarot card employed for a game, comprising:

a card manufacturing machine;

a print part printing an image responsive to the taste of a user and a game image necessary for a game selected by the user on said card, wherein said card include a storage part for rewritably storing information, and said card manufacturing machine comprises a writing part for writing information in said storage part.

6. A card manufacturing method utilizing a card manufacturing machine for manufacturing a card such as a playing card, a karuta or a tarot card employed for a game, comprising the steps of:

photographing an object;

selecting a desired image from a plurality of images; and printing an image obtained by said photographing and a game image selected by a user on one surface of said card; wherein said card includes a storage part for rewritably storing information, and a writing step of writing information in said storage part.

7. A card vending method including the card manufacturing method according to claim 6, wherein a card manufactured by said card manufacturing method is vended upon payment of a price.

8. A card vending method for vending a card such as a playing card, a karuta or a tarot card employed for a game, including the card manufacturing method according to claim 6, further comprising the steps of:

printing an image responsive to the taste of a user and a game image selected by the user on said card.

* * * * *